US006601327B2

(12) United States Patent
Ruebens

(10) Patent No.: US 6,601,327 B2
(45) **Date of Patent: *Aug. 5, 2003**

(54) BI-DIRECTIONAL ALBUM, WITH MEMO AREA

(75) Inventor: Jason I. Ruebens, Chatsworth, CA (US)

(73) Assignee: Pioneer Photo Albums, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/841,169

(22) Filed: Apr. 24, 2001

(65) Prior Publication Data

US 2002/0020091 A1 Feb. 21, 2002

Related U.S. Application Data

(63) Continuation of application No. 09/453,355, filed on Dec. 1, 1999, now Pat. No. 6,253,475, which is a division of application No. 08/482,171, filed on Jun. 7, 1995, now abandoned, which is a continuation of application No. 08/092,548, filed on Jul. 16, 1993, now abandoned, which is a continuation of application No. 07/555,063, filed on Jul. 18, 1990, now abandoned, which is a continuation-in-part of application No. 06/609,633, filed on May 14, 1984, now Pat. No. 4,965,948.

(51) Int. Cl.[7] ..... G09F 19/00
(52) U.S. Cl. ..... 40/537; 40/405; 40/530
(58) Field of Search ..... 40/405, 530, 531, 40/532, 535, 536, 537, 765, 776; 281/38

(56) References Cited

U.S. PATENT DOCUMENTS

| | | | | |
|---|---|---|---|---|
| 875,545 A | | 12/1907 | Macdonald | |
| 1,691,049 A | | 11/1928 | Douglas | |
| 1,889,420 A | | 11/1932 | Rubicam, Jr. | |
| 1,988,998 A | | 1/1935 | Cornish | 129/20 |
| 2,093,160 A | | 9/1937 | Steinthal | 281/33 |
| 2,421,503 A | | 6/1947 | Hermon | 129/20 |
| 2,986,144 A | | 5/1961 | Shepard | 129/20 |
| 3,245,166 A | | 4/1966 | Hagner | |
| 3,555,713 A | | 1/1971 | Leinbach | |
| 3,596,393 A | | 8/1971 | Lithgow | |
| 3,651,591 A | | 3/1972 | Woodyard | |
| 3,956,836 A | | 5/1976 | Seaborn | |
| 4,247,999 A | | 2/1981 | Latino | 40/359 |
| 4,356,649 A | | 11/1982 | Diamond et al. | |
| 4,405,228 A | | 9/1983 | Muscoplat | 355/75 |
| 4,447,973 A | | 5/1984 | Wihlke | |
| 4,458,435 A | | 7/1984 | Ackerman | 40/530 |
| 4,468,053 A | | 8/1984 | Bradley | 281/31 |
| 4,965,948 A | * | 10/1990 | Ruebens | 40/537 |
| 6,253,475 B1 | * | 7/2001 | Ruebens | 40/537 |

FOREIGN PATENT DOCUMENTS

| | | |
|---|---|---|
| DE | 534428 | 9/1931 |
| GB | 2030073 A | 4/1980 |

* cited by examiner

*Primary Examiner*—Brian K. Green
(74) *Attorney, Agent, or Firm*—Jeffer, Mangels, Butler & Marmaro LLP

(57) ABSTRACT

A bidirectional album for the storage of photographs and the like in which typically rectangular photographs may be retained in either a latitudinal or longitudinal vertical orientation. Each page of an album leaf is partially covered by a transparent sheet attached along several of its edges to a leaf page. Additional lines of attachment between the transparent sheet and leaf page are disposed and oriented so as to permit horizontal storage of photos and the like between the attachment lines. Photos and the like can also be stored in a vertical orientation under the sheet adjacent the storage lines.

3 Claims, 2 Drawing Sheets

BI-DIRECTIONAL ALBUM, WITH MEMO AREA

RELATED U.S. APPLICATION DATA

This application is a continuation of U.S. application Ser. No. 09/453,355, filed Dec. 1, 1999, now U.S. Pat. No. 6,253,475 B1, which is a division of application Ser. No. 08/482,171, filed on Jun. 7, 1995, now abandoned, which is a continuation of application Ser. No. 08/092,548, filed on Jul. 16, 1993, now abandoned, which is a continuation of application Ser. No. 07/555,063, filed on Jul. 18, 1990, now abandoned, which is a continuation-in-part of application Ser. No. 06/609,633, filed on May 14, 1984, now U.S. Pat. No. 4,965,948.

BACKGROUND OF THE INVENTION

1. Field of the Invention

The present invention concerns devices for the storage and display of photographs and the like, and more particularly to photo albums.

2. Description of the Prior Art

Devices for the storage and display of photographs and the like have taken many forms. One form, commonly referred to as a photograph album, comprises a plurality of bound leaves disposed within an outer cover with photographs or similar objects mounted on the two planar surfaces, or display pages, of each leaf. The leaves within the photograph album are commonly made of either a stiff cardboard material or a flexible transparent plastic. In the latter instance, two sheets of transparent plastic are bound together to form a plurality of pockets into which photographs are inserted.

A number of means for mounting photographs on the album pages are employed with cardboard-type leaves. One of the most common mounting means involves taping or gluing the photographs to the display pages. Another common mounting means involves a small adhesive-backed device, called a "corner," having a triangular-shaped pocket to receive a corner edge of a photograph. Typically four "corner" devices are disposed over the corner edges of a photograph and retained on the display page by the adhesive backing on the "corner" device.

All of these adhesive mounting means suffer from a similar defect in that the adhesives employed dry out with the passage of time, enabling the photographs to fall out of the album. These mounting means further discourage the replacement of photographs mounted in an album since removal frequently damages or defaces the photograph and/or the display page.

Another mounting means employed in conjunction with cardboard-type leaves involves coating the entire album page with an adhesive substance which retains the photographs on the album page. A transparent plastic sheet is attached to the album page to cover the photographs and the album page and prevent adjacent album leaves from adhering together. While this approach does provide a good mount, it fails to provide a convenient "memo" area on which to place information pertinent to the stored photographs. The adhesive used in this approach can also change over time, either increasing the risk of damage to the photo when removed or allowing the photo to fall from the album.

The use of transparent plastic album leaves also suffers from a number of disadvantages. For example, the size and orientation of the album pockets are constant. An album designed to store and display a particular size photograph cannot store photographs in a larger format as may be subsequently offered by photograph film developing businesses. Photograph orientation is important since most commercially available photographs have a rectangular shape with the image displayed on the photograph usually having an obvious vertical (i.e., "up-and-down") orientation. The vertical orientation of the photograph may coincide with the longer longitudinal axis of the photograph or the shorter latitudinal axis, depending upon the orientation of the camera when the photograph was taken. Photographers will occasionally orient a camera sideways to avail themselves of advantageous picture framing situations. The photographer thus develops a collection of photographs having both longitudinal and lateral vertical orientations. Prior art transparent plastic album leaves typically provide only a single longitudinal or latitudinal vertical orientation, thus limiting the photographer's framing choices. While a few prior art transparent plastic album leaves have been produced with album pockets having both longitudinal and latitudinal vertical orientations, the number of album pockets per leaf with each orientation is constant and transparent plastic album leaves of this type cannot permit both longitudinal and latitudinal vertical orientation within the same area on a single album page. To avoid wasting album space, the photographer is constrained to having the remaining space in his album dictate the framing orientation of his photographic composition.

Transparent plastic album leaves also fail to provide a convenient memo area. Pertinent information may be written on the back of the photograph, but only at the risk of damaging the photograph since the writing ink may seep through to the image side of the photograph. Further, use of the back side of the photograph as a memo area reduces the number of photographs that may be conveniently stored in each leaf.

Thus, there exists a need for a more versatile photo album permitting the bi-direction storage and display of photographs on the same portion of a display page without employing an adhesive mounting means which also includes a convenient information memo area.

SUMMARY OF THE INVENTION

In accordance with the present invention, there is provided an improved device for the storage and display of photographs and the like, i.e., an improved photo album. The improved bi-directional photo album of the present invention permits display of either longitudinal or latitudinal vertically oriented photographs on the same area of an album display page. Further, photographs may be easily inserted and replaced over any period of time without damaging either the album page or the photograph. Moreover, photographs will not slip out of the album regardless of the album orientation. Finally, a memo area is also provided on each display page for the recordation of information pertinent to adjacently stored photographs. An index sheet provides quick reference to the display page on which a particular photograph or like object is stored.

According to the preferred embodiment, the bi-directional photo album of the present invention comprises a plurality of bound leaves and an index sheet disposed within and coupled to an outer cover. A transparent cover is attached to three edges of each display page of each album leaf. Orientation ribs formed by lines of attachment between the transparent cover and the display page provide for the adjacent display of either several latitudinal vertically oriented photographs or a latitudinal vertically oriented photograph and a longitudinal vertically oriented photograph or two longitudinal vertically oriented photographs on the same display page. A writing surface is provided on each display page for recordation thereon of information pertinent to an adjacently stored photograph.

The novel features which are believed to be characteristic of the invention, together with further objectives and advantages thereof, will be better understood from the following description considered in connection with the accompanying drawings in which a presently preferred embodiment and an alternate embodiment of the invention are illustrated by way of example. It is to be expressly understood, however, that the drawings are for the purpose of illustration and description only, and are not intended as a definition of the limits of the invention.

DESCRIPTION OF THE PREFERRED EMBODIMENT

Figure 1:
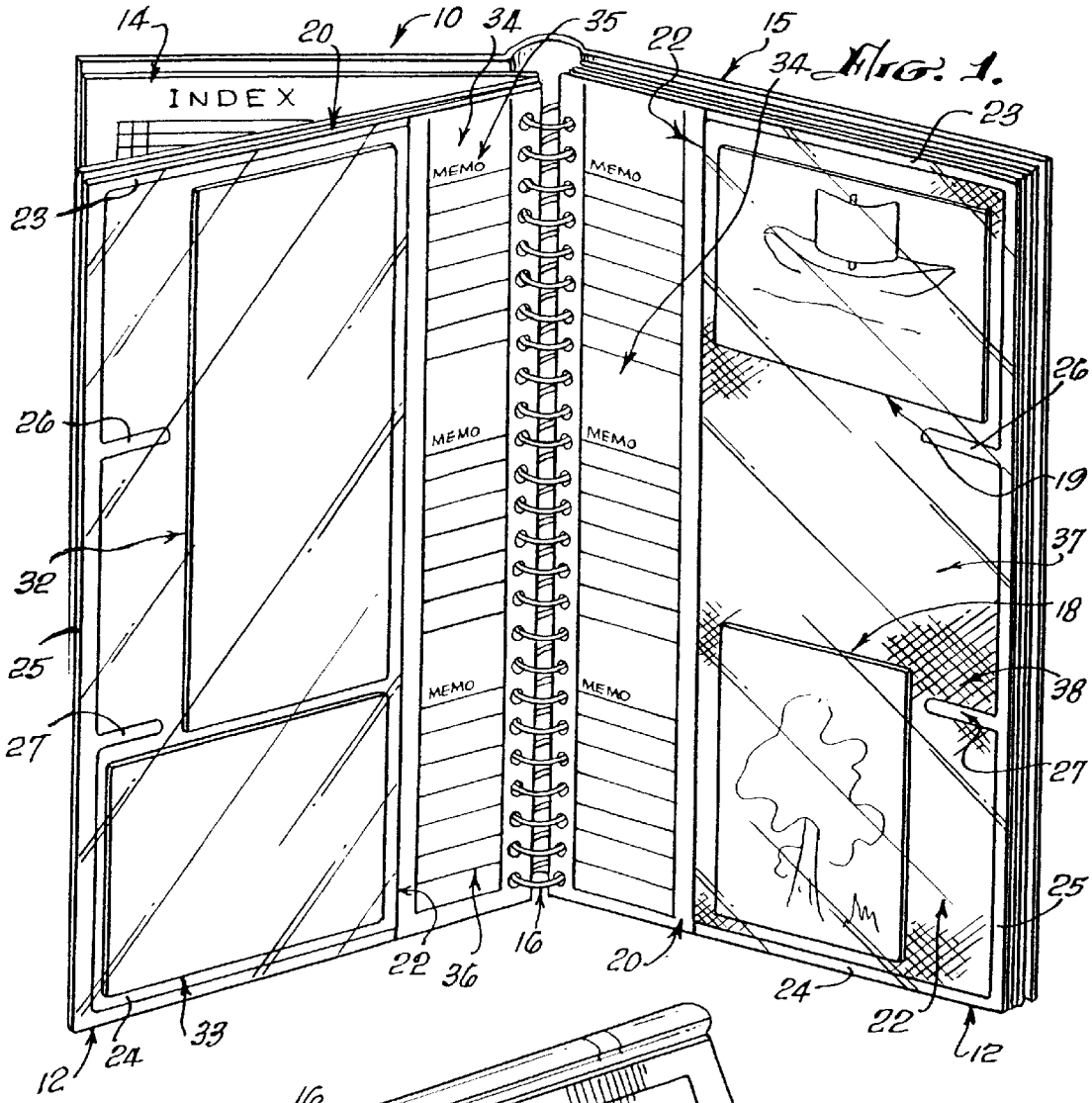
FIG. 1 is a perspective view of a preferred embodiment of the invention.

Referring now to the drawings, and more particularly to FIG. 1 thereof, there is shown a preferred embodiment of a bi-directional album, generally designated 10, of the present invention. The bi-directional album 10 includes a plurality of leaves 12 and an index sheet 14 disposed within an outer cover 15 and bound together by a binding means 16 which is attached to the outer cover 15. Each album leaf 12 has two oppositely directed planar surfaces, or display pages, generally designated as 20, on which photographs 18 and 19 and like objects are stored and displayed. A transparent cover 22 is disposed adjacent and attached to a portion of each display page 20 so as to form a pocket. Photographs 18 and 19 are stored beneath the transparent cover 22. The index sheet 14 is provided for recordation thereon information pertinent to the location of a particular photograph within the bi-directional album 10. This index sheet 14 provides a simple and convenient method of accessing a particular photograph stored on a particular display page.

Figure 2:
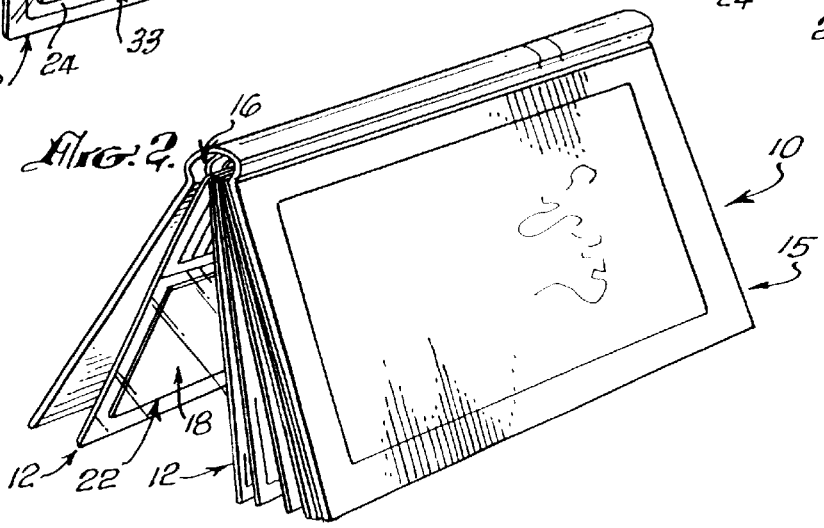
FIG. 2 is a further perspective view in which a preferred embodiment of the present invention has been opened to show opposing display pages of two adjacent album leaves.
Figure 3:
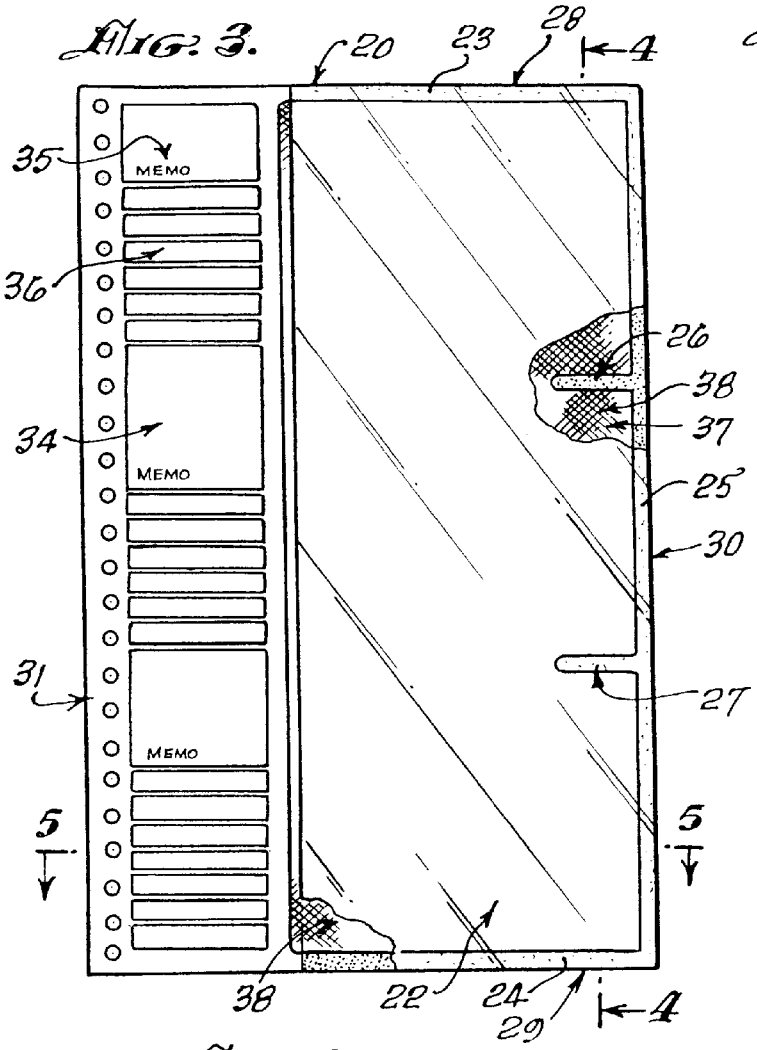
FIG. 3 is a detailed view of a display page of an album leaf of a preferred embodiment of the present invention.
Figure 4:
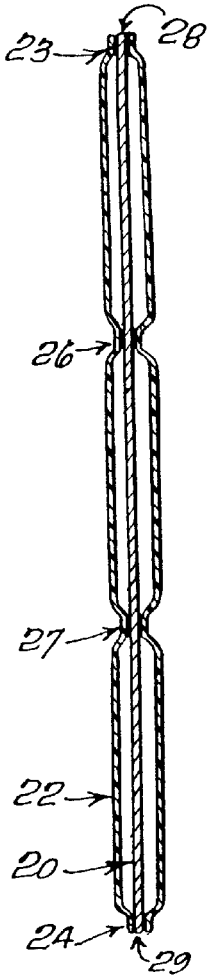
FIG. 4 is a cross-sectional view of an album leaf of a preferred embodiment of the present invention taken along the line 4—4 in FIG. 3.
Figure 5:
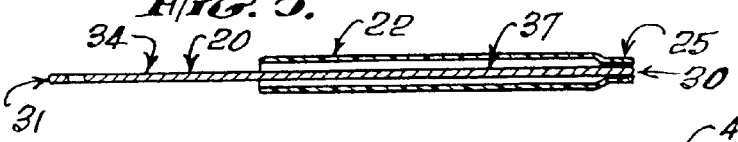
FIG. 5 is a cross-sectional view of an album leaf of a preferred embodiment of the present invention taken along the 5—5 in FIG. 3.

As shown in FIGS. 3 through 5, the transparent cover 22 is attached to the display page 20 along various lines of attachment generally designated as 23 through 27. The transparent cover 22 may be attached to the display page 20 by any convenient means such as, for example, various well-known types of adhesives. Attachment lines 23 and 24 are disposed adjacent lateral album leaf edges 28 and 29. A third attachment line 25 is disposed adjacent an album leaf edge 30 opposite an album leaf edge 31 engaging the binding means 16. This arrangement prevents the photographs from slipping out of the bi-directional album 10 when the album 10 is oriented as shown in FIG. 2. Two transverse lines of attachment further affix the transparent cover 22 to the display page 20 so as to form two orientation ribs 26 and 27.

The orientation ribs 26 and 27 are in spaced relationship approximately the same distance from one another and the attachment lines 23 and 24 adjacent the lateral album leaf edges 28 and 29. The orientation ribs 26 and 27 are approximately parallel to the attachment lines 23 and 24 and extend from the attachment line 25 adjacent the album leaf edge 30 towards the album leaf edge 31 engaging the binding means 16. The length of the orientation ribs 26 and 27 should not exceed, approximately, the difference between the longitudinal and latitudinal measurements of the largest photograph 32 to be stored in the bi-directional album 10.

The length, orientation, and location of the orientation ribs 26 and 27 permit adjacent storage of either latitudinal or longitudinal vertically oriented photographs on the same portion of the display pages 20 of the present invention. Thus, three latitudinal vertically oriented photographs having the same orientation as photograph 19 in FIG. 1 or two longitudinal vertically oriented photographs having the same orientation as photograph 18 or a combination of a latitudinal and a longitudinal vertically oriented photograph, as shown in FIG. 1 with photographs 18 and 19, may be stored on the same display page 20. Adhesives are not required to retain photographs and the like on the display page 20. The orientation ribs 26 and 27 secure the transparent cover 22 in sufficient proximity to display page 20 to effectively retain latitudinal vertically oriented photographs of maximum dimensions, such as photograph 33 in FIG. 1, between the orientation ribs 26 and 27. Longitudinal vertically oriented photographs of maximum dimensions, such as photograph 32, are effectively retained adjacent the orientation ribs 26 and 27. Photographs having dimensions less than the dimensions of the largest photographs to be stored in the bi-directional album 10 may also be conveniently stored within the album without the use of adhesives. Consequently, photographs and the like may be removed and replaced throughout the useful life of the bi-directional album 10 without risk of damage to either the stored photographs or the display page 20.

It should be understood that a greater or lesser number of orientation ribs may be included, depending on the number and size of photographs and the like to be stored on the display page 20, without departing from the spirit of the invention. Similarly, the length of the orientation ribs will vary depending on the maximum size of photographs intended for storage in the bidirectional album 10.

As shown in FIGS. 3 and 5, the transparent cover 22 is disposed over only a portion of the display page 20 surface. A writing surface 34 is provided on the uncovered portion of display page 20 adjacent album leaf edge 31 for the recordation of information pertinent to an adjacently stored photograph. This writing surface 34 obviates the need to record pertinent information on the rear surface of the photograph. The writing surface 34 may have imprinted thereon various indicia 35 and 36 to facilitate the recordation of information.

The surface area 37 of the display page 20 covered by the transparent cover 22 also has imprinted thereon contrasting indicia 38 for aesthetic purposes. As shown in FIG. 1, the contrasting indicia 38 are partially obscured by photographs and the like stored on the display page 20.

Numerous alterations could be introduced without departing from the spirit of the invention. For example, the writing surface 34 shown adjacent the album leaf edge 31 engaging the binding means could be located adjacent the opposing album leaf edge 30. Various types of binding means 16 could be employed, for example, engaging the album leaves 12 in a greater or lesser number of locations. A binding means permitting the insertion and removal of album leaves 12 from the album could also be employed. A greater number of orientation ribs could be included and disposed substantially as disclosed above for storage of a greater number of photographs.

Figure 6:
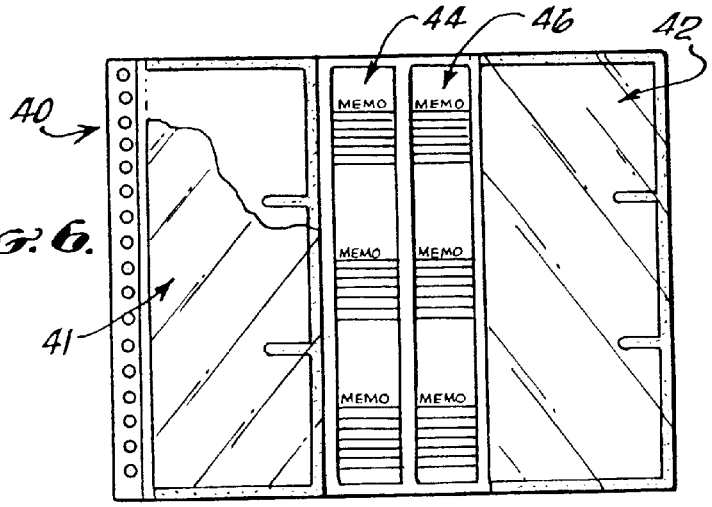
FIG. 6 is a detailed view of a display page of an album leaf of an alternate embodiment of the present invention.

In an alternate embodiment of the present invention, shown in FIG. 6, a display page 40 has two transparent panels 41 and 42 attached in the manner disclosed above. Two adjacent writing surfaces 44 and 46 are provided in the middle of the display page 40, between the transparent panels 41 and 42.

In a still further embodiment, two transparent panels and two writing surfaces could be provided on each page in an alternating arrangement, having a writing surface disposed adjacent an album leaf edge engaging a binding means and, adjacent thereto, a transparent cover followed thereafter by a second writing surface followed by a second transparent cover.

From the foregoing, it is believed that the invention may be readily understood by those skilled in the art without further description. As discussed above, numerous changes may be made in the details disclosed without departing from the spirit of the invention, as set forth in the claims below.

What is claimed is:

1. A photo album page for holding at least one photograph, the photo album page comprising two sheets of generally planar material, at least one sheet being substantially transparent, both sheets having a top edge, a bottom edge and first and second opposing side edges and defining a width from the first side edge to the second side edge, the sheets being generally fixed relative to each other, whereby one sheet is a top sheet and the other sheet is a bottom sheet, at least two attachment locations disposed between the transparent sheet top edge and the transparent sheet bottom edge to define at least one photograph receiving area for receiving at least one photograph between the two sheets, the at least two attachment locations having a length dimension and a width dimension, the attachment location length dimension being greater than the attachment location width dimension, the at least two attachment locations being arranged with their length dimension extending in the width direction of the top sheet, the length dimension of the at least two attachment locations being less than the width of the top sheet, at least one attachment location defining a free end adjacent to the photograph receiving area, the free end of the at least one attachment location being spaced from the second side edge of the top sheet to define a portion of the photograph receiving area, wherein the vertical distance between adjacent attachment locations in the direction of the transparent sheet top edge to the transparent sheet bottom edge and the distance between a bottom attachment location and the transparent sheet bottom edge is approximately equal.

2. In a photo album having a cover, a plurality of bound leaves for mounting photographs, each leaf having top and bottom edges and first and second opposing side edges, the improvement comprising:

a plurality of transparent covers, each transparent cover defining a width between first and second opposing side edges and having top and bottom edges, the cover having a free edge, a transparent cover being associated with a respective one of the leaves with the transparent cover disposed closely adjacent a planar surface of an associated leaf so as to define a pocket and further including a plurality of orientation ribs, each rib having a length dimension and a width dimension, the rib length dimension being greater than the rib width dimension, the length dimension of each rib being less than the width of the transparent cover and each rib having a free end, at least two of the ribs being disposed to define a space for receiving photographs between the cover bottom edge and one rib and between the cover top edge and another rib, and wherein with respect to at least one orientation rib, the distance from the free edge of the transparent cover to the free end of the orientation rib defines a first distance, wherein the shortest distance between at least two adjacent orientation ribs in the direction of the cover top edge to the cover bottom edge is at least equal to the first distance, and wherein the distance between the top edge of the transparent cover and an adjacent orientation rib is at least equal to the first distance, and wherein the distance from the bottom edge of the transparent cover and an adjacent orientation rib is at least equal to the first distance.

3. A photo album page for holding at least one photograph, the photo album page comprising two sheets of generally planar material, at least one sheet being substantially transparent, both sheets having a top edge, a bottom edge and first and second opposing side edges and defining a width from the first side edge to the second side edge, the sheets being generally fixed relative to each other, whereby one sheet is a top sheet and the other sheet is a bottom sheet, at least two attachment locations disposed between the transparent sheet top edge and the transparent sheet bottom edge to define at least one photograph receiving area for receiving at least one photograph between the two sheets, the at least two attachment locations having a length dimension and a width dimension, the attachment location length dimension being greater than the attachment location width dimension, the at least two attachment locations being arranged with their length dimension extending in the width direction of the top sheet, the length dimension of the at least two attachment locations being less than the width of the top sheet, at least one attachment location defining a free end adjacent to the photograph receiving area, the free end of the at least one attachment location being spaced from the second side edge of the top sheet to define a portion of the photograph receiving area, wherein the shortest distance between adjacent attachment locations in the direction of the transparent sheet top edge to the transparent sheet bottom edge and the distance between a bottom attachment location and the transparent sheet bottom edge is approximately equal.

* * * * *